US006637054B2

(12) United States Patent
Chuang

(10) Patent No.: US 6,637,054 B2
(45) Date of Patent: Oct. 28, 2003

(54) PROTECTIVE COMFORTER COVER BAG

(76) Inventor: Henry Chuang, 422 E. Valley Blvd., San Gabriel, CA (US) 91776

( * ) Notice: Subject to any disclaimer, the term of this patent is extended or adjusted under 35 U.S.C. 154(b) by 0 days.

(21) Appl. No.: 10/053,119

(22) Filed: Jan. 23, 2002

(65) Prior Publication Data

US 2003/0135924 A1 Jul. 24, 2003

(51) Int. Cl.[7] ..... A47G 9/00
(52) U.S. Cl. ..... 5/502; 5/482
(58) Field of Search ..... 5/482, 486, 488, 5/502, 500, 923

(56) References Cited

U.S. PATENT DOCUMENTS

| | | | | | |
|---|---|---|---|---|---|
| 1,347,642 | A | * | 7/1920 | McNatt | 5/501 |
| 2,222,782 | A | * | 11/1940 | Moses | 5/500 |
| 2,516,363 | A | * | 7/1950 | Block et al. | 5/500 |
| 2,789,298 | A | * | 4/1957 | Budinquest | 5/486 |
| 3,584,323 | A | * | 6/1971 | Worley | 5/413 R |
| 4,777,681 | A | * | 10/1988 | Luck et al. | 5/502 |
| 5,005,236 | A | * | 4/1991 | Hutchinson | 5/502 |
| 6,032,308 | A | * | 3/2000 | Chuang | 5/502 |

FOREIGN PATENT DOCUMENTS

| | | | | |
|---|---|---|---|---|
| CA | 621371 | * | 6/1961 | 5/501 |
| GB | 431558 | * | 2/1935 | 5/413 R |
| GB | 519243 | * | 10/1938 | 5/502 |
| GB | 1341960 | * | 9/1970 | 5/413 R |

* cited by examiner

*Primary Examiner*—Teri Pham Luu
(74) *Attorney, Agent, or Firm*—Raymond Y. Chan; David and Raymond Patent Group

(57) ABSTRACT

The present invention relates to a protective comforter cover bag which includes a rectangular bag body having a first cover sheet and a second cover sheet peripherally connected together to define a comforter cavity therebetween. The first comforter has an inlet access for placing at least one comforter into the comforter cavity of the cover bag. The inlet access is a quadrilateral opening having four side edges extended along a first side, a second side, a third side and a fourth side of the bag body respectively. The first cover sheet includes a central cover piece having a first edge side, a second edge side, a third edge side and a fourth edge side, wherein the first and the third edge sides of the central cover piece are integrally connected to the first and the third side edges of the inlet access respectively, thus effectively forming an two elongated inlet opening on the first cover sheet of the bag body. The protective comforter cover bag further includes a securing device for firmly shutting the inlet access, and a mounting device for firmly attaching the one or more than one comforter pieces evenly spread inside the comforter cavity of the cover bag.

20 Claims, 8 Drawing Sheets

PROTECTIVE COMFORTER COVER BAG

BACKGROUND OF THE PRESENT INVENTION

1. Field of Invention

The present invention relates to comforters, and more particularly to a protective comforter cover bag which comprises a detachable outer cover bag for easily receiving and fixing at least compatible inner separate piece insulation.

2. Description of Related Arts

Generally speaking, most people all over the world spend about one-third of their life in sleeping, thus it is very important for them to maintain a clean and comfortable bed. A standard bed usually consists of a fitted sheet, a set of pillows, a flat sheet, a blanket and a comforter to keep human's body warm. Unfortunately, all these linen are extremely easy to trap dust, bacteria, and other hazardous dirt particles. For most of the linen, except comforter, it is relatively easy to maintain clean and comfort. For instances, one can easily wash, with a standard household washing machine, or simply replace without incurring significant cost, the likes of fitted sheet, flat sheet, pillow covers and the blanket. However, washing or buying a comforter is usually very troublesome, inconvenient or expensive. Furthermore, for each time a dirty comforter goes through a standard washing process, the comforter is destroyed very slightly and hardened due to water absorbent. Hence, the more frequent a comforter is washed, the more likely the comforter is destroyed. It is because, as a general rule, the life span of the delicate insulation materials within the comforter will not be durable if the comforter absorbs moisture or water frequently.

Some people try to use a washable cover bag to place the comforter therein. But it can be very troublesome for a person to put the comforter into the cover bag. A conventional cover bag usually provides opening at one side only, therefore, the user has to squeeze the big comforter into the cover bag through that only opening. After that, the user in turn has to find the four corners of the squeezed comforter inside the cover bag and match each corner of the comforter to each corner of the cover bag so that they can be aligned properly.

Usually a user must firstly find out two corners of one side of a comforter to align with two corners of a cover bags. Then, the user has to firmly hold that two corner positions (now the user holds the comforter and the cover bag together) and lift the comforter as well as the cover bag up vertically. The user further has to shake the comforter and the cover bag together until the other two corners of the comforter fall into the two corners of the cover bags respectively. The above-mentioned typical procedure for covering a comforter with a cover bag causes much inconvenience to the user and therefore discourages people from using it.

Another big shortcoming of a typical comforter cover bag is that the comforter within the cover bag, once properly aligned, is very easily shifted aside or even curled up after overnight use. This requires the user to realign the comforter and the cover bag every morning.

Some people would like to purchase more than one comforter to suit different weather conditions and temperatures. This situation is superficially fine and natural. However, it is this kind of practice that genuinely reflects the inherent inadequacy of conventional comforters that all of them can only exist in their corresponding predefined thickness and have no room for any adjustment. This indisputably incurs to user both tangible extra expense—money, as well as intangible extra expense—extra space for storage.

In the market today, there are many varieties of comforters, but not yet one can solve the above-mentioned problems. The present invention is the solution of the above problems.

SUMMARY OF THE PRESENT INVENTION

The main object of the present invention is to provide a protective comforter cover bag which enables the user to put at least a comforter to spread therein easily and conveniently through two parallel openings provided on a top surface of the protective comforter cover bag.

Another object of the present invention is to provide a protective comforter cover bag which enables more than one comforters evenly spread in a layer-by-layer without any curling up or out of alignment by connecting the edges and corners of the comforters to the inner sides of the protective comforter cover bag by means of a mounting means through the two parallel openings provided on the top surface of the protective comforter cover bag. Moreover, it can adjust the overall thickness of the comforter according to the desire of the user.

Another object of the present invention is to provide a protective comforter cover bag which can prolong the life span of the comforter inside.

Accordingly, in order to accomplish the above objects, the present invention provides a protective comforter cover bag which comprises a rectangular bag body having a first cover sheet and a second cover sheet peripherally connected together to define an interior comforter cavity therebetween. The first cover sheet comprises a boundary piece and a central cover piece. The boundary piece has a central quadrilateral hole forming an inlet access for placing at least one comforter piece into the comforter cavity of the cover bag, wherein the inlet access has a first side edge, a second side edge, a third side edge which is parallel with the first side edge, and a fourth side edge which is parallel with the second side edge and is covered by the central cover piece which has two parallel sides connected to the second and fourth side edges of the inlet access of the first cover sheet respectively and another two parallel sides covering the first and third side edges respectively so as to define two elongated inlet openings extended along the first side edge and the third side edge of the inlet access of the boundary piece respectively so as to communicate the interior comforter cavity with outside. The protective comforter cover bag further comprises a pair of securing devices provided at the two elongated inlet openings for closing the two elongated inlet openings respectively, and a mounting means comprising a plurality of fasteners affixed to at least four corners of the bag body for firmly attaching with at least four corners of the comforter piece placed within the bag body, so as to mount the comforter piece evenly spread in position inside the comforter cavity.

DETAILED DESCRIPTION OF THE PREFERRED EMBODIMENTS

Figure 1:
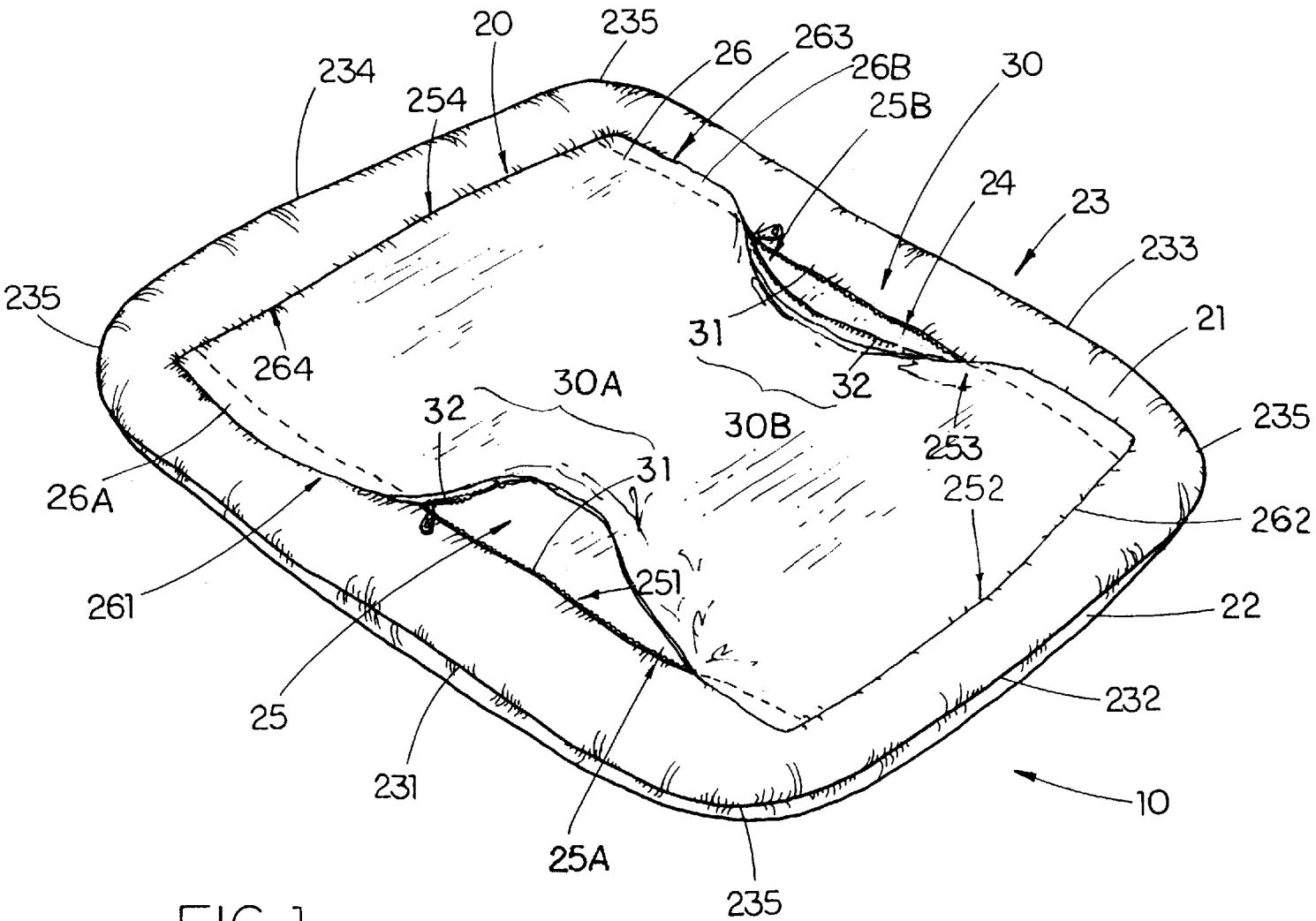
FIG. 1 is a perspective view of a protective comforter cover bag according to a first preferred embodiment of the present invention.

Referring to FIGS. 1 to 5 of the drawings, a protective comforter cover bag according to a preferred embodiment of the present invention is illustrated. The protective comforter cover bag comprises a rectangular bag body 20 which is constructed by two evenly measured sheets of cloth materials and comprises a first cover sheet 21 and a second cover sheet 22 facing back-to-back and sewed peripherally to form a peripheral side edge 23 of the protective comforter cover bag. The peripheral side edge 23 has four sides which are the first side 231, the second side 232, the third side 233 which is parallel to the first side 231, and the fourth side 234 which is parallel to the second side 232. All these first, second, third, and fourth sides 231, 232, 233, 234 together define a comforter cavity 24 between the first cover sheet 21 and the second cover sheet 22 and form four corners edges 235 of the protective comforter cover bag.

The first cover sheet 21 has an inlet access 25 formed thereon for placing at least one comforter piece 50 into the comforter cavity 24 of the bag body 20. The inlet access 25 is an quadrilateral opening having a first side edge 251, a second side edge 252, a third side edge 253 and a fourth side edge 254 extended along the first side 231, the second side 232, the third side 233, and the fourth side 234 of the first cover sheet 21 of the bag body 20 respectively. The first cover sheet 21 further comprises a central cover piece 26 for covering the inlet access 25. The central cover piece 26 has a first edge side 261, a second edge side 262, a third edge side 263, and a fourth edge side 264, wherein the second edge side 262 and the fourth edge side 264 are integrally connected with the second side edge 252 and the fourth side edge 254 of the inlet access 25, thus effectively forming two elongated inlet openings 25A, 25B at the first edge side 261 and the third edge side 263 to communicate the comforter cavity 24 with outside, wherein the two elongated inlet openings 25A, 25B are extended along the first side edge 251 and the third side edge 253 of the inlet access 25 with respect to the central cover piece 26.

The central cover piece 26 has a size slightly larger than the size of the inlet access 25. On the other hand, the size of the inlet access 25 must be sufficiently large to enable a user to easily reach and observe any interior sides 231–234 and corners 235 within the comforter cavity 24 through the inlet access 25.

The protective comforter cover bag further comprises a securing means 30 which is positioned along the two elongated inlet openings 25A, 25B of the first cover sheet 21 of the bag body 20 and mounted between the central cover piece 26 and the first cover sheet 21, for selectively operating the inlet access 25 to be opened or closed. The securing means 30 comprises two first securing members 31 and two second securing members 32, wherein the first securing members 31 are respectively affixed along the first and the third side edges 251, 253 of the inlet access 25 on the first cover sheet 21, whereas the second securing members 32 are respectively affixed, along the first and the third edge sides 261, 263, under the central cover piece 26.

In accordance with the present embodiment, the securing means 30 comprises a pair of zippers 30A, 30B having lengths the same as the first side edge 251 and the third side edge 253 respectively. For each zipper 30A, 30B, a first zipper half 31 of it is affixed by sewing on the first cover sheet 21 along the first side edge 251 (or the third side edge 253) of the inlet access 25 of the first cover sheet 21, whereas a second zipper half 32 of each zipper 30A, 30B is affixed by sewing under the central cover piece 26 and extended adjacent to the first edge side 261 (or the third edge side 263) of the central cover piece 26. Therefore, a user can zip the zippers 30A, 30B to close the two inlet openings 25A, 25B of the inlet access 25 or to open the two inlet openings 25A, 25B of the inlet access 25 for placing the comforter piece 50 into the comforter cavity 24 of the bag body 20. Since the central cover piece 26 is slightly larger than the size of the inlet access 25, two cover edges 26A, 26B are formed along the first and third edge sides 261, 263 of the central cover piece 26 to cover the pair of zippers 30A, 30B. Thus, in a sense, the two respective first zipper halves of the two zippers 30A, 30B constitute the two first securing members 31, and the two respective second zipper halves of the two zippers 30A, 30B constitute the two second securing members 32.

Figure 3:
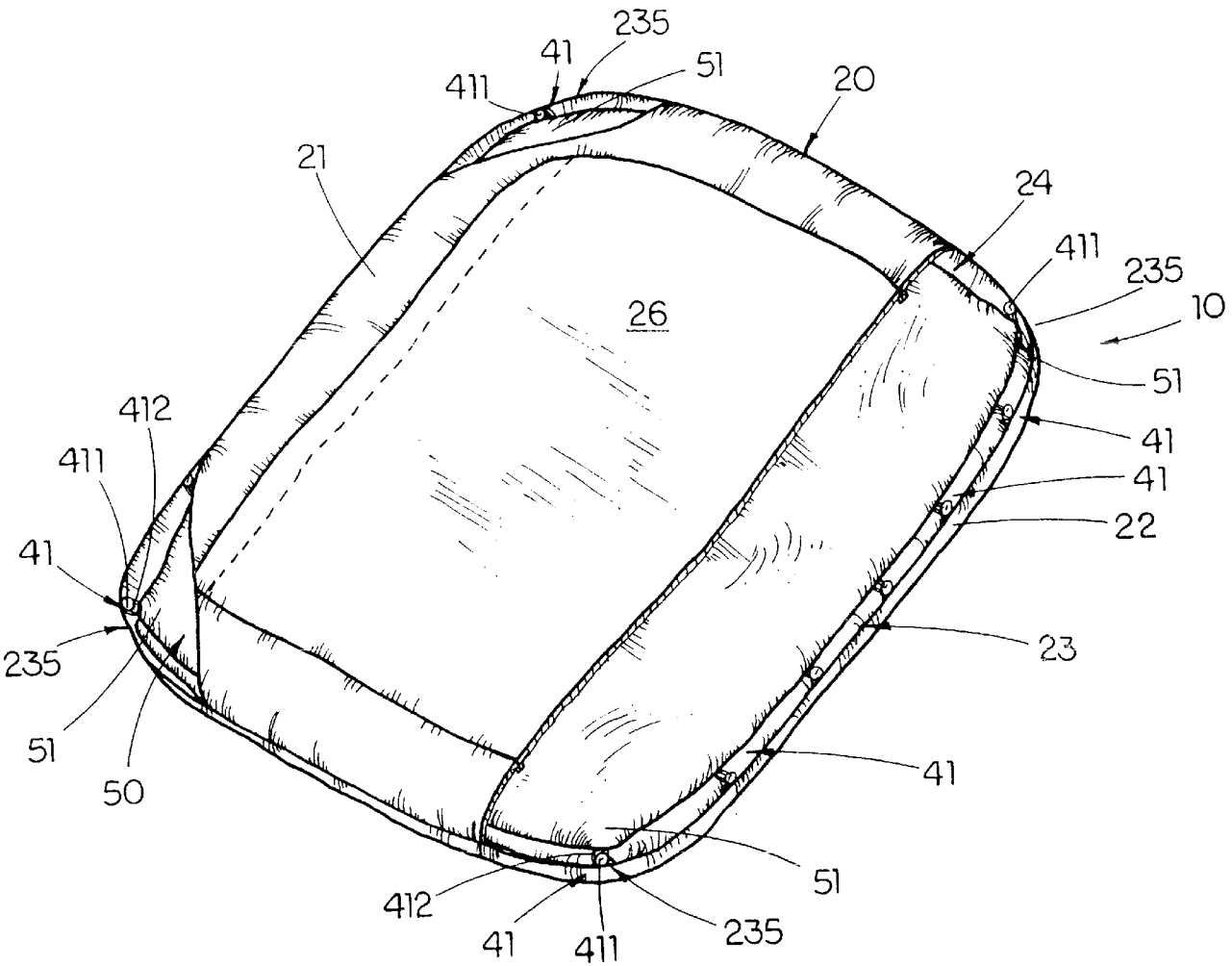
FIG. 3 is a sectional perspective view of a protective comforter cover bag according to the above first preferred embodiment of the present invention.
Figure 4:
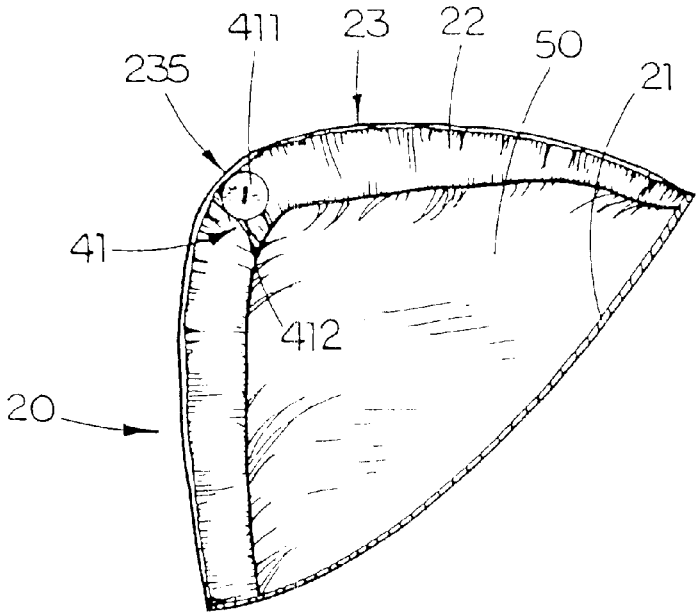
FIG. 4 is an enlarged partial sectional top view of a protective comforter cover bag according to the above first preferred embodiment of the present invention.
Figure 5:
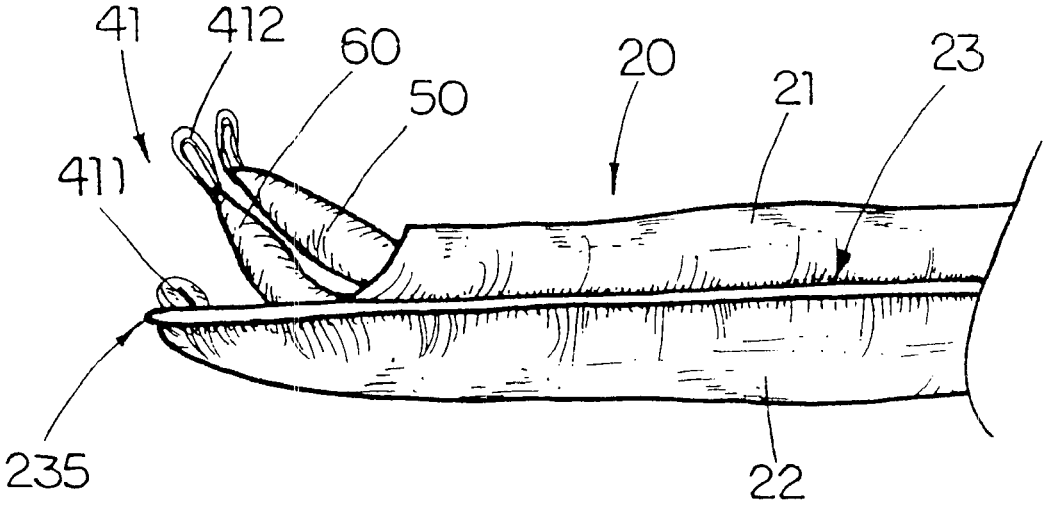
FIG. 5 is a sectional side view of a protective comforter cover bag according to the above first preferred embodiment of the present invention, illustrating the buttons and the loop connectors.

Referring to FIGS. 3–5 of the drawings, the protective comforter cover bag further comprises a mounting means 40 which comprises a plurality of fasteners 41 provided on at least four interior corners 235 of the comforter cavity 24 of the bag body 20, for firmly attaching with at least four corners 51(61) of the comforter piece 50(60) inside the comforter cavity 24 of the bag body 20 so as to mount the comforter piece 50 evenly spread in position. Each fasteners 41 comprises a first fastening member and a second fastening member, wherein the first fastening member is affixed on the interior side edge 23 of the bag body 20, whereas the second fastening member is affixed on the peripheral edge of the comforter piece 50.

Figure 2:
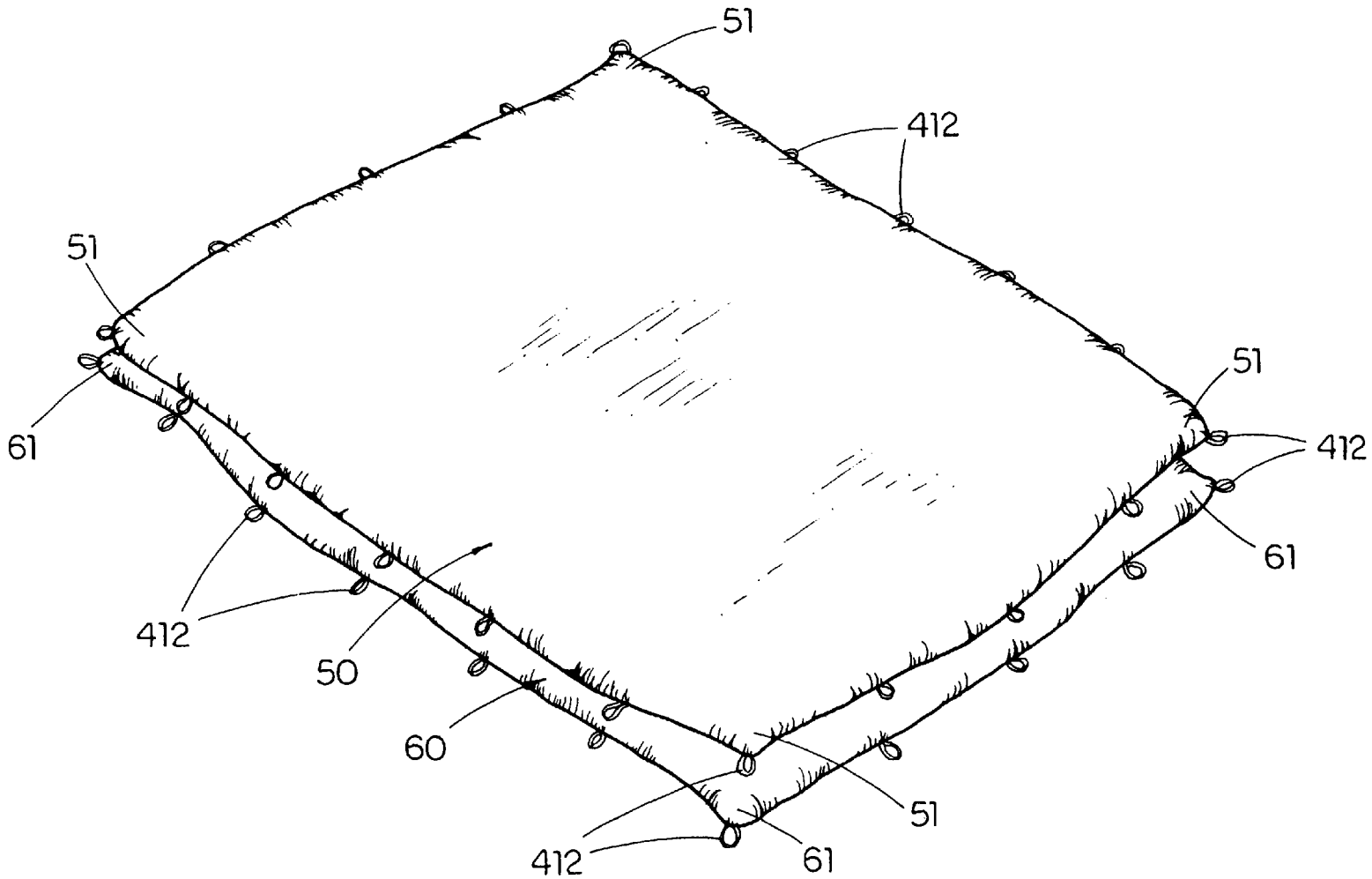
FIG. 2 is a perspective view of a protective comforter cover bag according to the above first preferred embodiment of the present invention, illustrating a plurality of connecting loops affixed along the periphery of the comforter pieces.

According to the first embodiment of the present invention, each of the fasteners 41 comprises a button 411 and a loop connector 412. The plurality of buttons 411 is sewed spacedly along the interior peripheral side edge 23 (including the four corners 235) of the bag body 20. As shown in FIG. 2, there are a thinner comforter piece 50 and a thicker comforter piece 60. Each of the comforter pieces 50 (60) is affixed with a plurality of the loop connectors 412 spacedly along a periphery of the comforter piece 50(60) in such a manner that the position of the loop connectors 412 on each comforter piece 50(60) are corresponding to the position of the buttons on the side edge 23. Each loop connector 412 comprises an elastic band or a strengthened strap with two ends sewed to the edge of the corresponding comforter piece 50 (60) to form a loop-shaped connector having a loop size slightly larger than the corresponding button 411. In a sense, the button 411 constitutes the first fastening member and the loop connector 412 constitutes the second fastening member.

To assemble the protective comforter cover bag with the comforter pieces 50, 60 as shown in FIGS. 3–5, one has first to spread the bag body 20 on a bed and the zip the pair of zippers 30A, 30B to open the two inlet openings 25A, 25B of the inlet access 25. Second, lift up the central cover piece 26 so that the user can place the comforter pieces 50, 60 one by one into the comforter cavity 24 through the elongated inlet opening of the first cover sheet 21. Third, connect all the loop connectors 412 on the comforter pieces 50, 60 to their corresponding buttons 411 of the bag body 20. In this way, the comforter pieces 50, 60 are mounted evenly spread within the comforter cavity 24 of the bag body 20. Finally, zip the pair of zippers 30A, 30B to close the two inlet openings 25A, 25B of the inlet access 25 of the bag body 20, so that the two comforter pieces 50, 60 are well, protected by the protective comforter cover bag.

In accordance with the two inlet openings 25A, 25B, the inlet access 25 and the securing means 30 provided in the present invention, the user can easily place and evenly spread the comforter piece 50, 60 within the comforter cavity 24 of the bag body 20. Since the assembly of the comforter pieces 50, 60 and the bag body 20 is rapid, easy and simple, the protective comforter cover bag of the present invention is thus adapted for receiving two or more comforter pieces 50, 60. Furthermore, due to the presence of the mounting means 40, each comforter piece 50, 60 can be firmly mounted in position inside the comforter cavity 24 of the bag body 20 and can be maintained in evenly spread condition anytime. The user can easily connect the loop connectors 412 of the comforter piece 50, 60 to the buttons 411 of the bag body 20 through the widely opened inlet openings 25A, 25B of the inlet access 25.

Accordingly, the user may selectively assemble one comforter piece 50, two comforter pieces 50, 60, or ever more than two comforter pieces 50, 60 inside the comforter cavity 24 depending on the weather or other circumstances. In summer, the user may use simply only the bag body 20 without any comforter piece 50 inside as a thin cover. In spring or autumn, the user may only need a thin comforter piece 50 at night. In early winter, the user may mount a thicker comforter piece 60 inside the cover bag. In the coldest period, the user may simply put the thin and thick comforter pieces 50, 60 or even two thick comforter pieces 60 inside the comforter cavity 24 to resist extremely cold weather.

Figure 6:
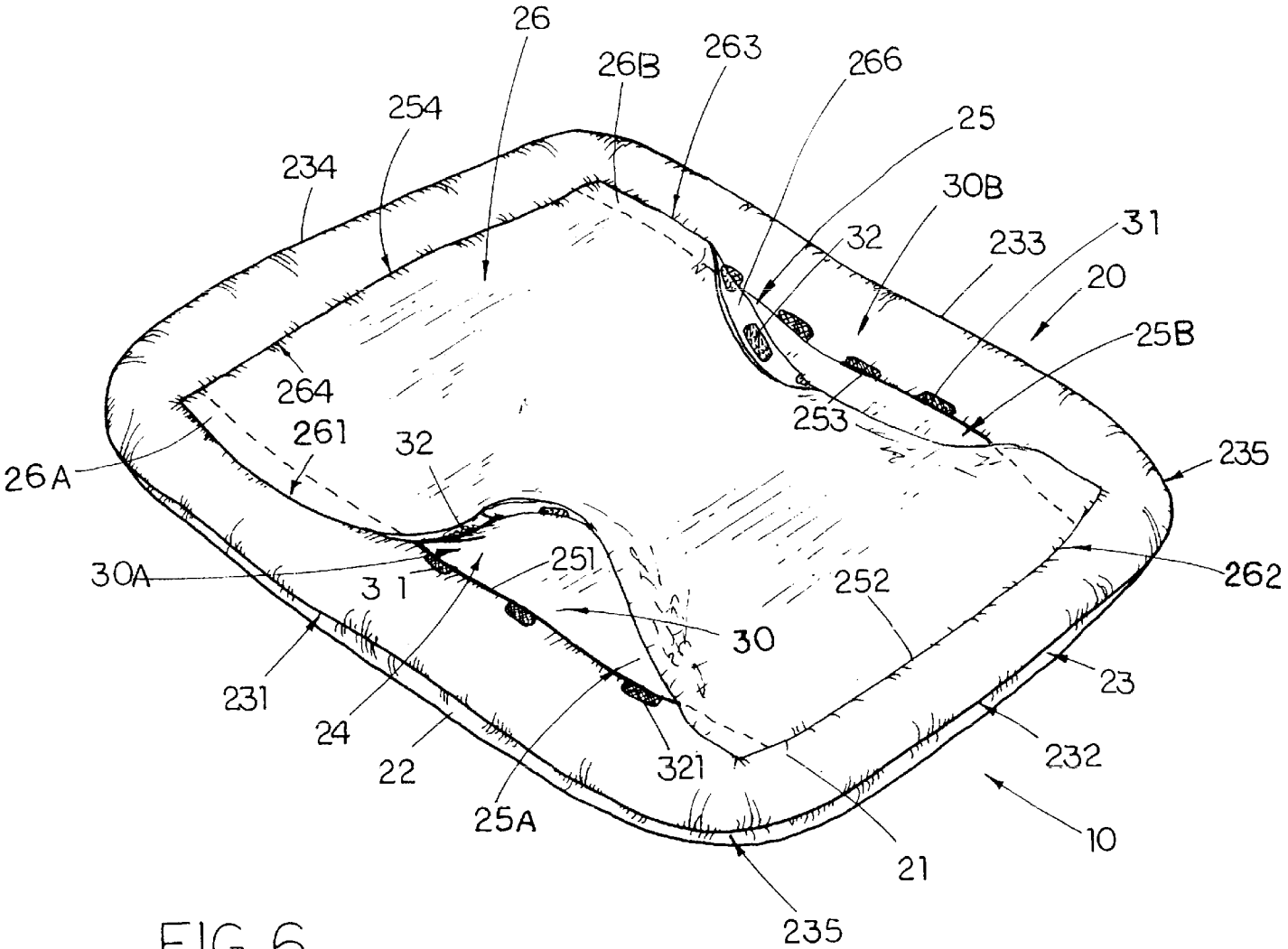
FIG. 6 is a perspective view of a protective comforter cover bag according to a second preferred embodiment of the present invention.
Figure 7:
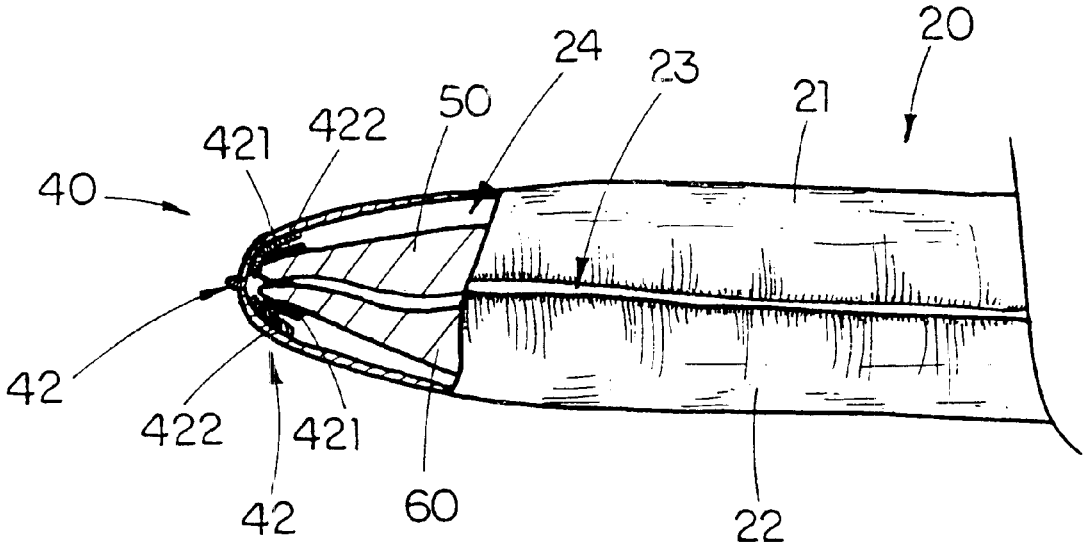
FIG. 7 is a sectional side view of a protective comforter cover bag according to a first alternative mode of the above preferred embodiments of the present invention.
Figure 8:
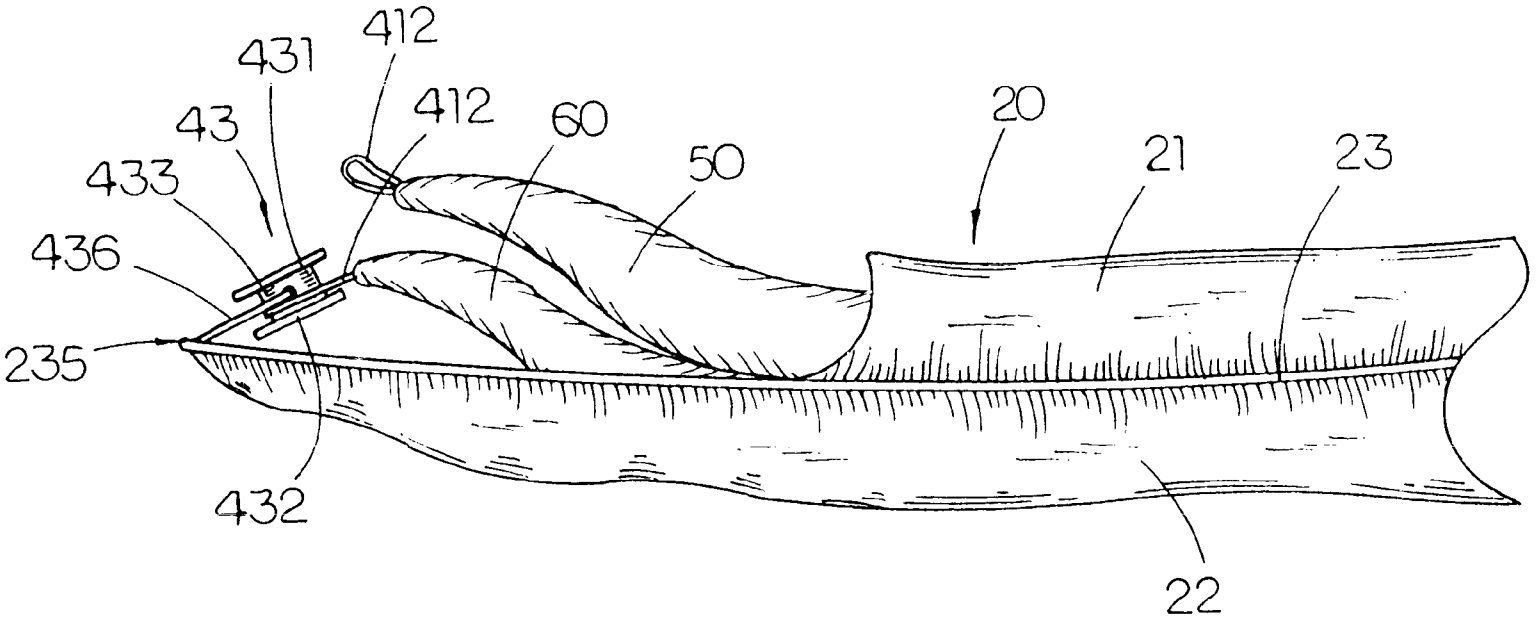
FIG. 8 is a perspective view of a protective comforter cover bag according to a second alternative mode of the above preferred embodiments of the present invention.

Referring to FIGS. 6–7 of the drawings, a second embodiment of the present invention is illustrated. Basically, the second embodiment has the same features of the above first embodiment except the securing means 30 and the mounting means 40. According to a second embodiment of the present invention, the securing means 30 comprises a plurality of loop and hook fasteners which comprises a plurality of loop fastener pads 31 spacedly affixed along the first and the third side edges 251, 253 of the inlet access 25 on the first cover sheet 21, and a plurality of corresponding hook fastener pads 32 spacedly affixed on an inner surface 266 of the central cover piece 26 along the first and the third edge sides 261, 263. Therefore, when the central cover piece 26 is positioned to cover the inlet access 25, the loop fastener pads 31 and the hook fastener pads 32 of the hook and loop fasteners are firmly attached with each other for shutting the two inlet openings 25A, 25B of the inlet access 25. In addition, when the central cover piece 26 is lifted upwardly, the hook fastener pads 32 will be detached from the loop fastener pads 31 so as to open the two inlet openings 25A, 25B of the inlet access 25. In other words, the zippers 30A, 30B in the above first preferred embodiment can replaced by the plurality of hook and loop fasteners 30A, 30B. In this sense, the loop fastener pads 31 constitute the two first securing members and the hook fastener pads 32 constitute the two second securing members.

As shown in FIG. 7 of the drawings, the mounting means 40 according to the second embodiment of the present invention comprises a plurality of hook and loop fasteners 42. Each hook and loop fastener 42 comprises a hook fastener pads 421 and a loop fastener pads 422. The plurality of the loop fastener pads 422 are affixed to an inner surface of the second cover sheet 22 spacedly along the periphery side edge 23 of the bag body 20. On the other hand, the plurality of the hoop fastener pads 421 are affixed to the peripheral edge of the comforter piece 50 in such a manner that the position of each hook fastener pads 421 matches with the position of its corresponding loop fastener pads 422. Therefore, the comforter piece 50 can be mounted firmly and evenly spread inside the comforter cavity 24 of the bag body 20 by attaching those hook fastener pads 421 on the comforter piece 50 (60) with the loop fastener pads 422 on the bag body 20. Moreover, the inner surface of the first cover sheet 21 is also affixed with a plurality of loop fastener pads 422 spacedly along the peripheral side edge 23 of the bag body 20. Accordingly, another comforter piece 60 may also be mounted inside the comforter cavity 24 by attaching a plurality of the hook fastener pads 421, which are spacedly affixed along the peripheral edge of the comforter piece 60, with the loop fastener pads 422 on the first cover sheet 21. Thus, in a sense, the hook fastener pads 421 constitute the first fastening member and the loop fastener pads 422 constitute the second fastening member.

Figure 9:
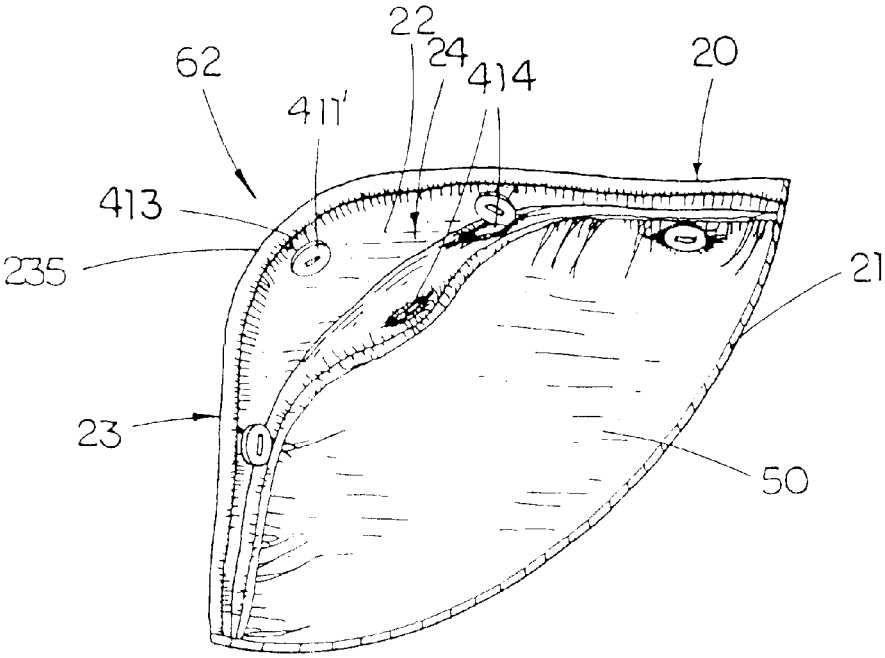
FIG. 9 is a perspective view of a protective comforter cover bag according to a third alternative mode of the above preferred embodiments of the present invention.

Referring to FIG. 9 of the drawings, a third preferred embodiment of the present invention is illustrated wherein the fourth embodiment is basically having the same features of the above first and the second embodiments except the mounting means 40 and the fasteners 41 therein. According to the third embodiment of the present invention, each of the mounting means 40 comprises a button 411' and a plurality of fastener strips 413 for securing the button 411' by the button holes thereof. The base of the predetermined fastener strips 413 is affixed to at least four interior corners 235 of the comforter cavity 24 of the bag body 20. Moreover, both thin and thick comforters 50, 60 have been punctured a plurality of stud holes 414 for receiving and fastening with the button 411' respectively. According to the third embodiment of the present invention, the comforter pieces 50, 60 can be held more abutting against the peripheral side edge 23 of the protective comforter cover bag.

What is claimed is:

1. A protective comforter arrangement specifically for covering on top of a user, comprising:

a bag body including a first cover sheet and a second cover sheet which are facing back to back and sewed peripherally together to form a peripheral side edge of said bag body and to define a comforter cavity between said first and second cover sheets, said peripheral side edge having a first side, a second side, a third side, a fourth side, and four corner edges, wherein an inlet access is formed on said first cover sheet and defined a surrounding portion along said first side, said second side, said third side, and said fourth side of said first cover sheet, wherein said inlet access has a first side edge, a second side edge, a third side edge, a fourth side edge extended along said first side, said second side, said third side, and said fourth side respectively, wherein said first cover sheet further comprises a central cover piece having a first edge side, a second edge side, a third edge side, and a fourth edge side, wherein said central cover piece is arranged to cover said inlet access by integrally connecting said second edge side and said fourth edge side of said central cover piece with said surrounding portion along said second side edge and said fourth side edge of said inlet access and thus two elongated inlet openings are defined along said first edge side and said third edge side to communicate said comforter cavity with outside, said two inlet openings; wherein a size of said inlet access is large enough for enabling a user to easily reach and observe said first, second, third, fourth sides and said four corner edges within said comforter cavity through said two inlet openings;

a securing means positioned along said two inlet openings of said first cover sheet of said bag body and mounted between said central cover piece and said surrounding portion of said first cover sheet, for selectively operating said two inlet openings of said inlet access to be opened or closed;

two or more comforter pieces which are adapted to be overlappingly received inside said comforter cavity of said bag body, each of said comforter pieces having four sides;

a plurality of buttons which are affixed spacedly along said peripheral side edge within said bag body; and a plurality of loop connectors which are spacedly affixed along said four sides of each of said comforter pieces, wherein said loop connectors of each of said comforter pieces a repositioned respective with said buttons affixed on said first, second, third, and fourth side edges of said bag body, each of said loop connectors comprising a strap having two ends sewed to a respective position along said four sides of each of said comforter pieces to form a loop adapted to hook on said respective button, wherein said loop connectors of one of said comforter pieces are positioned with respect to said loop connectors of said another comforter piece and tightly hooked to said buttons of said bag body respectively while said loop connectors of said another comforter piece are also tightly hooked to said buttons of said bag body respectively, so as to firmly and flatly mount said comforter pieces inside said comforter cavity of said bag body overlappingly.

2. The protective comforter arrangement, as recited in claim 1, wherein said securing means comprises two first securing members and two second securing members, wherein said first securing members are respectively affixed along said first and said third side edges of said inlet access on said first cover sheet, wherein said second securing members are respectively affixed, along said first and said third edge sides, under said central cover piece.

3. A protective comforter arrangement, as recited in claim 2, wherein each of said loop connectors is a strengthened strap having a diameter slightly larger than that of said button.

4. A protective comforter arrangement, as recited in claim 2, wherein each of said loop connectors is an elastic band having a normal diameter smaller than a diameter of said button for firmly fastening with said button.

5. A protective comforter arrangement, as recited in claim 2, wherein said comforter pieces have different thickness.

6. The protective comforter arrangement, as recited in claim 1, wherein said securing means comprises a pair of zippers having lengths said same as said first side edge and said third side edge respectively, wherein said two zippers comprise two first zipper halves respectively affixed by sewing on said first cover sheet along said first side edge and said third side edge of said inlet access of said first cover sheet, and two second zipper halves respectively affixed by sewing under said central cover piece and extended adjacent to said first edge side and said third edge side of said central cover piece, thereby by zipping said two zippers, said two inlet openings are capable of operating to be opened or closed.

7. The protective comforter arrangement, as recited in claim 6, wherein said central cover piece is slightly larger than said size of said inlet access that two cover edges are formed along said first and third edge sides of said central cover piece to cover said pair of zippers.

8. A protective comforter arrangement, as recited in claim 6, wherein each of said loop connectors is an elastic band having a normal diameter smaller than a diameter of said button for firmly fastening with said button.

9. A protective comforter arrangement, as recited in claim 6, wherein each of said loop connectors is a strengthened strap having a diameter slightly larger than that of said button.

10. A protective comforter arrangement, as recited in claim 6, wherein said comforter pieces have different thickness.

11. Said protective comforter arrangement, as recited in claim 1, wherein said securing means comprises a plurality of loop and hook fasteners which comprises a plurality of loop fastener pads spacedly affixed along said first and said third side edges of said inlet access on said first cover sheet, and a plurality of corresponding hook fastener pads spacedly affixed on an inner surface of said central cover piece along said first and said third edge sides, wherein when said central cover piece is positioned to cover said inlet access, said loop fastener pads and said hook fastener pads of said hook and loop fasteners are attached with each other for shutting said two inlet openings of said inlet access, wherein when said central cover piece is lifted upwardly; said hook fastener pads are detached from said loop fastener pads so as to open said two inlet openings of said inlet access.

12. The protective comforter arrangement, as recited in claim 11, wherein said central cover piece is slightly larger than said size of said inlet access that two cover edges are formed along said first and third edge sides of said central cover piece to cover said hook and loop fasteners.

13. A protective comforter arrangement, as recited in claim 11, wherein said comforter pieces have different thickness.

14. A protective comforter arrangement, as recited in claim 11, wherein each of said loop connectors is an elastic band having a normal diameter smaller than a diameter of said button for firmly fastening with said button.

15. A protective comforter arrangement, as recited in claim 14, wherein said comforter pieces have different thickness.

16. A protective comforter arrangement, as recited in claim 11, wherein each of said loop connectors is a strengthened strap having a diameter slightly larger than that of said button.

17. A protective comforter arrangement, as recited in claim 16, wherein said comforter pieces have different thickness.

18. A protective comforter arrangement, as recited in claim 1, wherein each of said loop connectors is a strengthened strap having a diameter slightly larger than that of said button.

19. A protective comforter arrangement, as recited in claim 1, wherein each of said loop connectors is an elastic band having a normal diameter smaller than a diameter of said button for firmly fastening with said button.

20. A protective comforter arrangement, as recited in claim 1, wherein said comforter pieces have different thickness.

* * * * *